US005623764A

United States Patent [19]

Cseh

[11] Patent Number: 5,623,764

[45] Date of Patent: Apr. 29, 1997

[54] HAIR CLIPPER

[76] Inventor: Ferenc Cseh, 37 Passaic St., Passaic, N.J. 07055

[21] Appl. No.: 453,213

[22] Filed: May 30, 1995

[51] Int. Cl.[6] ..... B26B 19/20; B26B 19/44

[52] U.S. Cl. ..... 30/133; 30/216

[58] Field of Search ..... 30/133, 208, 209, 30/215, 216

[56] References Cited

U.S. PATENT DOCUMENTS

| | | | |
|---|---|---|---|
| 2,292,453 | 8/1942 | La Mere | 30/133 |
| 3,063,146 | 11/1962 | Bray | 30/133 |
| 3,262,199 | 7/1966 | Magarian | 30/133 |
| 3,368,277 | 2/1968 | Ve Vea | 30/133 |
| 4,628,601 | 12/1986 | Van Slooten | 30/133 |
| 4,704,794 | 11/1987 | Paradis | 30/133 |

FOREIGN PATENT DOCUMENTS

| | | | |
|---|---|---|---|
| 549704 | 4/1932 | Germany | 30/133 |

*Primary Examiner*—Hwei-Siu Payer

[57] ABSTRACT

A precision hair clipper for cutting the hair to a predetermined length, energized solely by a vacuum source. A flow chamber having an inlet and an outlet which connected to an inlet of a turbine. The stator of the turbine is the handle of the hair clipper. The outlet of the turbine is connected to a vacuum source through a hose. In the inlet opening of the flow chamber the sucked in hair is cut by a wobbling-reciprocating narrow, double edged blade under a stationary blade opening to provide a pair of scissors action. The cutting mechanism is driven by the turbine through a speed reduction transmission. The length of hair after a cut depends on a selected spacer, connected to the inlet of the flow chamber.

1 Claim, 1 Drawing Sheet

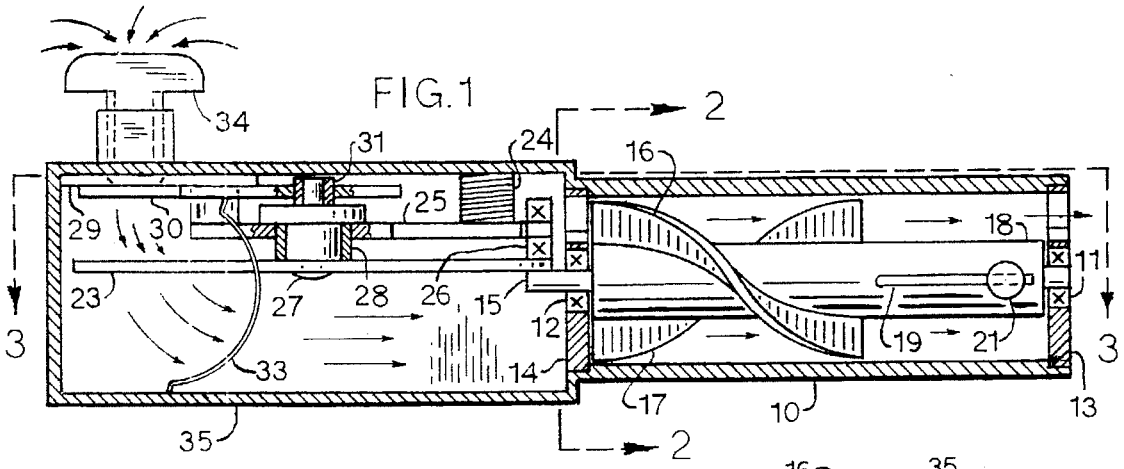
FIG. 1
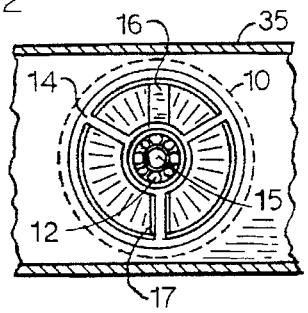
FIG. 2
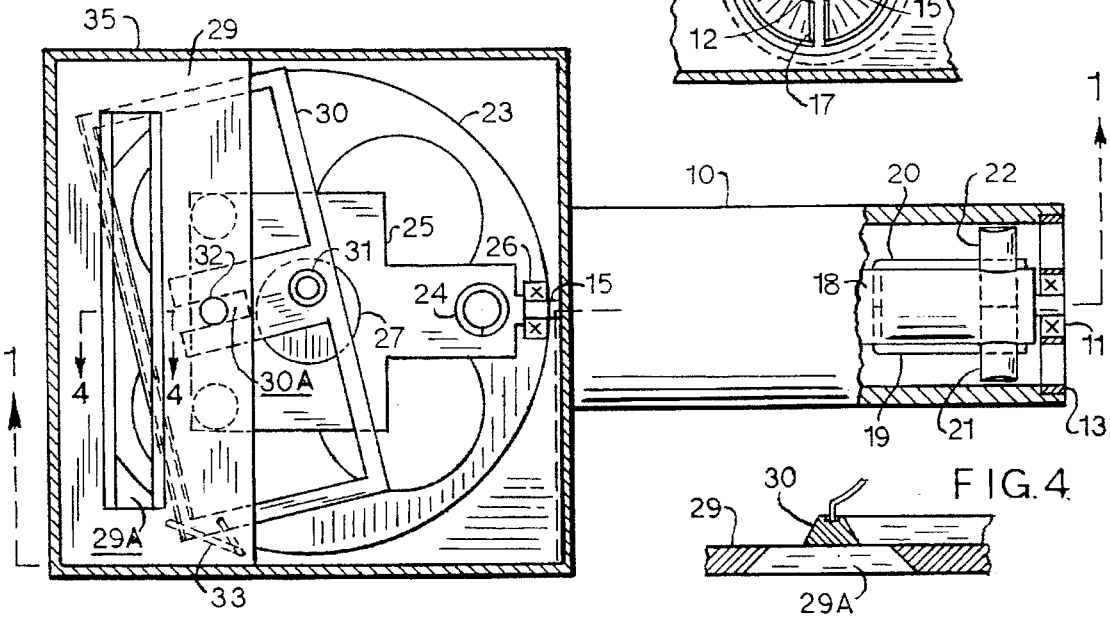
FIG. 3
FIG. 4
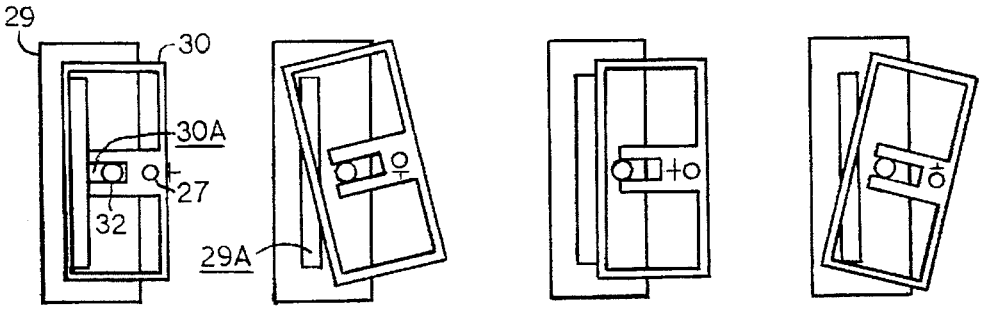
FIG. 5 FIG. 6 FIG. 7 FIG. 8

HAIR CLIPPER

FIELD OF THE INVENTION

This invention relates to the art of hair clippers that utilizes a vacuum source.

BACKGROUND OF THE INVENTION

By studying numerous patents in the prior art the Applicant have noticed that none of them is commercially viable except Hunts U.S. Pat. No. 4,679,322. However the disappointing performance and design of it prompted me to start a development effort. It was found that the machine was noisy, under powered, inclined to seizure. Required unusually powerful, 1.5 H.P. vacuum cleaner to operate. A significant obstruction of air flow by the cutting mechanism. It was cumbersome to set up. The machine needed an additional A.C. outlet, an A.C.-D.C. power supply with cable-connector. A socket on the hose, a cable in the hose, switch in the head. Needs electricity to operate, coupled with electric shock hazard.

It is believed that the subject matter will remedy the aforesaid disadvantages.

OBJECTS AND ADVANTAGES

The object of this invention is to provide a commercially viable, simple, user friendly, quiet, durable device. To accomplish that objectives, developed several essential elements such as:

A turbine that is incorporated into the handle of the hair clipper. Produces maximum torque to its size. Equipped with a centrifugal speed regulator that having a minimum of air obstruction. Succeeded to produce 140 grams centimeter torque at zero RPM with a 0.75 H.P. motor driven vacuum cleaner. On a 2.8 millimeter diameter output shaft it translates into 1000 grams driving force on the circumference. A turbine having maximum torque at zero revolution per minute and zero torque at maximum revolution per minute. The maximum power output is at half of the maximum revolution per minute. The centrifugal speed regulator is adjusted to about 10,000 RPM.

A high ratio power transmission that is inexpensive, quiet, durable and having high kinetic energy. A friction disc drive has been selected. The speed is reduced to one thirtieth and the torque is increased by thirty fold. The 1000 grams driving force of the turbine with a 9.66 leverage produces 9,660 grams cutting force, equals 21.46 Lb at near zero RPM. The kinetic energy adds to it, the friction deduct from it. The Hunts machine stops at 9.5 Lb brake force on the cutting blade. There are a dozen alternative power transmissions. All gears or gears and friction disc combination. They are noisier, cost more, having less kinetic energy but possess some size advantages.

A reciprocating cutting blade mechanism that cuts the hair like a pair of scissors in both direction. Having cutting edges of 45–60 degree. A very narrow construction to have minimum obstruction of air flow. Having friction only between the blades on small area to require small force to operate. The moving cutting blade is light weight, to produce negligible vibration. One of the two blades to be flexible to match easily the other blade. In case of overload with hair, room provided for the separating blades to prevent seizure.

A set of spacers to define the length of hair after cut. The spacers openings are small enough to provide great suction force for the hair to be cut. Small enough to limit the amount of hair sucked in. Large enough openings to supply a volume of air to the turbine to provide sufficient magnitude of power to actuate the cutting blade mechanism. A spacer is connected to the unit by forced sliding into its place.

Further objects and advantages of my invention will become apparent from a consideration of the drawing and ensuing description.

BRIEF DESCRIPTION OF THE DRAWING

FIG. 1 is a front view of the hair clipper. Some parts are broken away to see the power train and a centrifugal speed regulator.

FIG. 2 is a vertical section of the flow chamber to see a bearing support.

FIG. 3 is a top view of the hair clipper. Some parts are broken away to see the centrifugal speed regulator, cutting blade mechanism and the power transmission.

FIG. 4 is a section of the cutting blades.

FIGS. 5–8 are the four position of the mobile cutting blade in a cycle.

DESCRIPTION OF THE PREFERRED EMBODIMENT

With careful study of the drawing, can be seen how the figures help each other to understand the instant invention. Certain conventional details of construction that do not pertain to the invention have been eliminated for sake of clarity. A mostly aluminum construction.

A turbine having a stator 10 which is the handle of a hair clipper. In a stator 10 is a rotor that embedded in ball bearings 11 and 12. The bearings are fitted in bearing supports 13 and 14. The bearing supports are fitted into the ends of stator 10. In FIG. 2 can be seen a bearing support 14. A rotor having a steel output shaft 15 and two power producing helical ribbons 16 and 17. The helical ribbons are orthogonally fastened to the superficies of a core 18. The helical ribbons having an approximately 45 degree pitch and positioned opposed of each other for balance. The diameter of core 18 relative to the inside diameter of stator 10 is critical. A 1:1.77 ratio provided maximum torque with the given parameters. The gap between the helical ribbon and the stator is about 3–4 thousands of an inch.

The speed of a rotor is controlled by a centrifugal speed regulator. It can be seen at the right ends of FIG. 1 and FIG. 3. The speed regulator consist of two bent piano wire springs 19 and 20. One ends tightly fit in core 18, the other ends loosely fit in PTFE (Teflon) friction blocks 21 and 22. The friction blocks loosely fit in a transverse bore in core 18. The total length of friction blocks is about 93% of the inside diameter of stator 10. The speed regulator provides a fairly constant revolution per minute at regular load or no load and at smaller or higher vacuum.

The power transmission converts a turbine's power from high speed to low speed for a cutting mechanism. The output shaft 15 drives a steel or stainless steel disc 23 through friction between them. The friction is generated by a force of a compressed spring 24, transmitted through support plate 25, through ball bearing 26 to a disc 23.

The cutting mechanism receives the power to operate through the rotating disc 23, rivoted to the end of shaft 27. The shaft is embedded in sleeve bearing 28. The sleeve bearing 28 and the ball bearing 26 are tightly fitted in support plate 25 which is spaced and fastened to stationary cutting blade 29. The stationary cutting blade 29 has an opening 29A. The other end of shaft 27 ends in a smaller diameter pin with parallel axis to the shaft's to form an eccentric. An eccentric actuate the mobile cutting blade 30 through sleeve bearing 31. The bearing 31 is loosely fitted in the mobile cutting blade 30. The motion of a cutting blade 30 is controlled by a stationary guide pin 32 in a slot 30A of a mobil cutting blade 30. The result is a wobbling-reciprocating motion. The guide pin 32 is anchored in a stationary cutting blade 29 and a support plate 25. A mobile cutting blade 30 is pressed against a stationary cutting blade 29 by a U shape spring 33. There are 6 of them, one shown for clearity. They are spaced from each other to provide evenly distributed pressure on the cutting edges of a mobil cutting blade 30. Length, gauge, location are carefully selected to provide the proper pressure. The springs are make of piano wire.

One of a set of spacers is shown in FIG. 1. A spacer 34 is in its place to limit the length of hair to be cut. It is the distance from the tip of spacer 34 to a mobile cutting blade 30. Spacer 34 is slidingly connected to flow chamber 35.

Operation

A cycle of cutting action is illustrated in FIG. 5 to FIG. 8. The figures are bottom view of a cutting blade mechanism. In FIG. 5 an eccentric is in a 9 o'clock position. The opening of a stationary cutting blade is fully open, no cutting action, ready to accept a portion of hair to be cut. By moving to position of FIG. 6 a 12 o'clock position about half of the sucked in hair is cut by the inner edge of a mobile cutting blade and the inner edge of a stationary cutting blade like a pair of scissors. By moving to position of FIG. 7 a 3 o'clock position the rest of hair is cut by the inner edge of a mobile cutting blade and the inner edge of a stationary cutting blade. The opening on a stationary cutting blade is fully open, no cutting action, ready to accept a second portion of hair to be cut. By moving to position of FIG. 8 a 6 o'clock position the outer edge of a mobile cutting blade and the outer edge of a stationary cutting blade cut about half of the sucked in hair. By moving to position of FIG. 5 a 9 o'clock position the rest of sucked in hair is cut, completing a cycle.

I claim:

1. A cutting mechanism for use in a hair clipper comprising:

(1) a movable cutting blade having a slot;

(2) a stationary cutting blade having an opening for receiving hair to be cut;

(3) an eccentric connected to said movable cutting blade;

(4) said eccentric mounted on a shaft;

(5) a stationary pin received in said slot for guiding said movable cutting blade;

(6) said stationary pin being positioned between said eccentric and said opening; and whereby rotating said shaft results a wobbling-reciprocating motion of said movable cutting blade against the opening of said stationary cutting blade for cutting hair received in said opening.

* * * * *